US005300388A

United States Patent [19]

Inaba et al.

[11] Patent Number: 5,300,388

[45] Date of Patent: Apr. 5, 1994

[54] TONER FOR ELECTROPHOTOGRAPHY AND PROCESS FOR PRODUCING THE SAME

[75] Inventors: Yoshihiro Inaba; Kazufumi Tomita, both of Kanagawa, Japan

[73] Assignee: Fuji Xerox Co., Ltd., Tokyo, Japan

[21] Appl. No.: 908,842

[22] Filed: Jul. 1, 1992

Related U.S. Application Data

[63] Continuation of Ser. No. 649,005, Jan. 25, 1991, abandoned.

[30] Foreign Application Priority Data

Jan. 26, 1990 [JP] Japan ..... 2-14805

[51] Int. Cl.[5] ..... G03G 9/097

[52] U.S. Cl. ..... 430/110; 430/109; 430/137; 430/138

[58] Field of Search ..... 430/110, 137, 109, 138

[56] References Cited

U.S. PATENT DOCUMENTS

| | | | |
|---|---|---|---|
| 4,339,518 | 7/1982 | Okamura et al. | 430/110 |
| 4,869,990 | 9/1989 | Hosoi | 430/110 |
| 5,100,754 | 3/1992 | Yoerger et al. | 430/137 |
| 5,149,611 | 9/1992 | Kohri et al. | 430/110 |

FOREIGN PATENT DOCUMENTS

| | | | |
|---|---|---|---|
| 63-53559 | 3/1980 | Japan | 430/110 |

*Primary Examiner*—Christopher Rodee

*Attorney, Agent, or Firm*—Finnegan, Henderson Farabow, Garrett & Dunner

[57] ABSTRACT

A toner for electrophotography having good electrification stability even under high-temperature and high-humidity conditions is disclosed, which comprises toner particles having a radical-formable substance at least on the surfaces thereof and a copolymer adherent to said surfaces, said copolymer containing as monomer units at least one vinyl group-containing carboxylic acid represented by formulae (I), (II), and (III) and a fluorine-containing vinyl monomer:

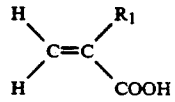
(I)

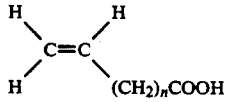
(II)

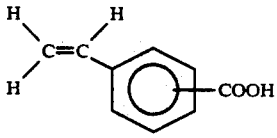
(III)

wherein $R_1$ represents hydrogen atom or methyl group and n is an integer of 1 to 8.

4 Claims, No Drawings

TONER FOR ELECTROPHOTOGRAPHY AND PROCESS FOR PRODUCING THE SAME

This application is a continuation of application Ser. No. 07/649,005 filed Jan. 25, 1991, now abandoned.

FIELD OF THE INVENTION

The present invention relates to a toner for use in developing electrostatic latent images in electrophotography and electrostatic printing, and to a process for producing the toner.

BACKGROUND OF THE INVENTION

Various kinds of toners are known in which fluorine-containing compounds are provided on the surfaces of toner particles for the purpose of obtaining improved development properties.

For example, JP-A-58-66950 (the term "JP-A" as used herein means an "unexamined published Japanese patent application") discloses a capsule toner in which an organic fluorine compound is provided on the capsule surfaces; JP-A-59-181358 discloses a capsule toner in which a fluorine-containing resin is provided on the capsule surfaces; JP-A-60-126657 discloses a capsule toner prepared by using a fluorine-containing compound as one of interfacially polymerizable monomers for forming the shell material; JP-A-61-120160 discloses a capsule toner having electrification properties imparted by reacting a fluorinecontaining alcohol with carboxyl or isocyanate groups present on the shell; and JP-A-63-177145, JP-A-63-177147, and JP-A-63-177148 disclose a capsule toner in which high-molecular chains have been formed on the shell surfaces by graft polymerization of a monomer containing a fluorine atom as a charge-control group.

However, all of the toners described above have been still unsatisfactory. Illustratively stated, the toner disclosed in JP-A-58-66950 is disadvantageous in that the independence of electrification on the environment, especially on humidity, is poor because the organic fluorine compound used therein contains, in each molecule thereof, a hydrophilic group besides a hydrophobic group including the fluorine atom. The toner disclosed in JP-A-59-181358 is defective in that since the fluorine-containing resin used is a polymer or copolymer whose structure is the same as hydrocarbon substituted with fluorine atoms, the adhesion between the resin and the capsule shells is so poor that the resin readily peels off. The capsule toner disclosed in JP-A-60-126657 has a drawback that it is difficult to attain satisfactory properties with respect to both the mechanical properties of shells and the electrification properties of toner by use of the same shell material and, hence, latitude in selection of the shell materials is narrow. The toner disclosed in JP-A-61-120160 has the following problems. In the case where capsule shells are formed by way of interfacial polymerization, it is difficult to allow carboxyl or isocyanate groups to be present on the shell surfaces because both of these groups are functional groups that take part in interfacial polymerization. Further, the reactions of these functional groups with an alcohol do not sufficiently proceed in an aqueous solution, resulting in necessity of use of an organic solvent. Therefore, a solvent-recovery apparatus should be provided and the production equipment should be explosion-proofed, increasing the production cost of the toner. The toner disclosed in JP-A-63-177145, JP-A-63-177147, and JP-A-63-177148 is disadvantageous in that vinyl fluoride, which is the only example shown therein as the monomer containing a fluorine atom, is gaseous at room temperature and, hence, grafting of such vinyl fluoride onto capsule surfaces necessitates a special reactor.

It has further been proposed to maintain the electrification stability of a toner by use of a metal complex or the like. However, this technique has many disadvantages. For example, it is difficult to control the dispersion of a metal complex in a toner, and since metal complexes generally have colors, they cannot be used with colored toners.

SUMMARY OF THE INVENTION

An object of the present invention is to provide a toner which eliminates the drawbacks of the prior art techniques as described above.

That is, the object is to provide a toner which shows good electrification stability to the environment, has a sharp electrification distribution, and is never impaired in electrification properties by mechanical force, and which can be prepared with considerable latitude in selection of starting materials without necessity of special reactors.

The object has been attained by a toner for electrophotography, which comprises toner particles having a radical-formable substance at least on the surfaces thereof and a copolymer adherent to the surfaces, the copolymer containing, as monomer units, at least one vinyl group-containing carboxylic acid represented by the following formulae (I), (II), and (III) and a fluorine-containing vinyl monomer:

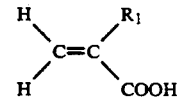
(I)

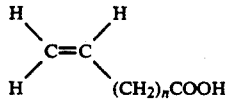
(II)

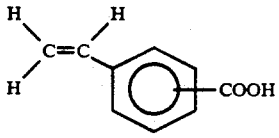
(III)

wherein $R_1$ represents a hydrogen atom or methyl group and n is an integer of 1 to 8.

DETAILED DESCRIPTION OF THE INVENTION

The "radical-formable substance", in the present invention, means a substance which undergoes a hydrogen atom-pulling reaction or addition reaction with a monomer radical or with cerium (IV) ion to form a radical. Examples of the radical-formable substance include polymers such as polyamides, polyureas, polyurethanes, polyesters, polyvinyl acetate, polyvinyl alcohol, cellulose, synthetic rubbers, styreneacrylate copolymers, styrene-methacrylate copolymers, epoxy resins, phenoxy resins, acrylic resins, and the like, and mixtures thereof.

In the toner for electrophotography according to the present invention, the toner particles having such a radical-formable substance at least on the surfaces thereof may be constituted by the radical-formable substance alone, or may have a capsular structure consisting of a shell of the radical-formable substance and a core material encapsulated in the shell.

In the case where the toner particles are constituted by the radical-formable substance alone, the particles may contain therein a colorant. Examples of the colorant include inorganic pigments such as carbon black, red iron oxide, Prussian blue, titanium oxide, etc.; azo dyes such as fast yellow, disazo yellow, pyrazolone red, chelate red, brilliant carmine, para brown, etc; phthalocyanine pigments such as copper phthalocyanine, metal-free phthalocyanine, etc.; and condensed polycyclic compound pigments such as flavanthrone yellow, dibromoanthrone orange, perylene red, quinacridone red, dioxazine violet, etc. In addition to these, disperse dyes, oil-soluble dyes, and the like may be used. It is also possible to replace part or all of the black colorant with a magnetic powder to give a single-component magnetic toner. As the magnetic powder, a powder of magnetite, ferrite, or a metal which is elemental cobalt, iron, nickel, etc.; or an alloy thereof may be used.

Carbon black and the organic dyes or pigments are generally contained in amounts of 1 to 10 wt% based on the weight of the toner particles, and the magnetic powder in generally contained in an amount of 10 to 80 wt% based on the weight of the toner particles.

In the case where the toner particles have a capsular structure, the resin constituting the shells is preferably a polyurea resin, polyurethane resin, polyamide resin, polyester resin, epoxy resin, epoxy-urea resin, or epoxy-urethane resin. Of these, a polyurea resin, a polyurethane resin, a combination of a polyurea and polyurethane resins, an epoxy-urea resin, an epoxy-urethane resin, or a combination of an epoxy-urea and epoxy-urethane resins is particularly preferred as the shell material.

It is preferable that capsule toners for use in pressure fixing and capsule toners for use in heat fixing have different shell thicknesses. In pressure fixing, the shell thickness is preferably from 0.05 to 2.0 μm and more preferably from 0.1 to 1.0 μm, whereas in heat fixing it is preferably from 0.01 to 1.0 μm and more preferably from 0.05 to 0.5 μm. Further, the shells of these two kinds of toners may differ from each other in the kinds or proportions of constituent ingredients.

As the core material in the capsule toner particles, a core material consisting mainly of ingredients having pressure-fixing properties is used for pressure fixing, while a core material consisting mainly of ingredients having heat-fixing properties is used for heat fixing. A particularly preferred core material for pressure fixing consists mainly of a binder resin, a high-boiling solvent that dissolves the resin, and a colorant, or consists mainly of a soft solid substance and a colorant. If desired or necessary, a magnetic powder may be used in place of the colorant, or an additive such as silicone oil may be added for the purpose of improving fixing properties. It is also possible to add a high-boiling solvent that does not dissolve the binder resin to the high-boiling solvent that dissolves the binder resin. It is desirable that core materials for pressure fixing differ from core materials for heat fixing in the kinds or proportions of constituent ingredients.

As the colorant for use in the core material, any of those described above may be employed and contained in amounts also described above but based on the weight of the core material. The colorant need not be contained in the core and may be present at the interface between the core and the shell or contained in the shell. Particularly, when the colorant has a hydrophilic surface like magnetic powders or when the colorant is incorporated as an ingredient of the core material together with a low-boiling solvent which is expelled from the capsule during formation of the shell by way of interfacial polymerization, the colorant is apt to be present at the interface or in the shell after formation of the shell.

As the binder resin, a known resin for fixing may be used. Examples thereof include acrylic ester polymers such as polymethyl acrylate, polyethyl acrylate, polybutyl acrylate, 2-ethylhexyl acrylate polymer, and polylauryl acrylate, methacrylic ester polymers such as polymethyl methacrylate, polybutyl methacrylate, polyhexyl methacrylate, 2-ethylhexyl methacrylate polymer, and polylauryl methacrylate, copolymers of styrene-type monomer(s) with acrylic or methacrylic ester(s), polyvinyl acetate, polyvinyl propionate, ethylene-based polymers and copolymers such as polyethylene and polypropylene, styrene-based copolymers such as styrene-butadiene copolymers, styrene-isoprene copolymers, and styrene-maleic acid copolymers, polyvinyl ethers, polyvinyl ketones, polyesters, polyamides, polyurethanes, rubbers, epoxy resins, polyvinyl butyral, rosins, modified rosins, terpene resins, phenolic resins, and the like. These may be used alone or as a mixture of two or more thereof. It is also possible to introduce into a reactor a monomer or monomers for forming a binder resin, subsequently encapsulate the monomer(s) and then polymerize the monomer(s) in situ, to give the desired binder resin.

As the high-boiling solvent that dissolves the binder resin, an oil-soluble solvent having a boiling point of 140° C. or higher, preferably 160° C. or higher, may be used. For example, a solvent to be used as the high-boiling solvent may be selected from those given under "Plasticizers" in "Modern Plastics Encyclopedia (1975-1976)". A suitable solvent may also be selected from the high-boiling solvents which are disclosed, for example, in JP-A-58-145964 and JP-A-63-163373 as core materials for pressure-fixing capsule toners.

Specific examples of the high-boiling solvent include phthalic acid esters (e.g., diethyl phthalate and dibutyl phthalate); aliphatic dicarboxylic acid esters (e.g., diethyl malonate and dimethyl oxalate); phosphoric acid esters (e.g., tricresyl phosphate and trixylyl phosphate); citric acid esters (e.g., o-acetyl triethyl citrate); benzoic acid esters (e.g., butyl benzoate and hexyl benzoate); aliphatic acid esters (e.g., hexadecyl myristate and dioctyl adipate); alkylnaphthalenes (e.g., methylnaphthalene, dimethylnaphthalene, monoisopropylnaphthalene, and diisopropylnaphthalene); alkyldiphenyl ethers (e.g., o-, m-, or p-methyldiphenyl ether); higher fatty acid amides or aromatic sulfonamides (e.g., N,N-dimethyllauroamide and N-butylbenzenesulfonamide); trimellitic acid esters (e.g., trioctyl trimellitate); diarylalkanes (e.g., diarylmethanes such as dimethylphenylphenylmethane, and diarylethanes such as 1-phenyl-1-methylphenylethane, 1-dimethylphenyl-1-phenylethane, and 1-ethylphenyl-1-phenylethane); chlorina paraffins; and the like.

The soft solid substance is not particularly limited as long as it is flexible at room temperature and has fixing properties. Preferably, however, the soft solid substance is a polymer having a Tg in the range of from −60° C. to 5° C. (e.g., polylauryl methacrylate, lauryl methacrylate-styrene copolymers, and lauryl methacrylate-methyl methacrylate copolymers) or a mixture of such a polymer with 1 to 50 wt% (based on the mixture) of other polymer(s) such as those having a Tg of more than 5° C. to 60° C. (e.g., polystyrene, polyacrylates, polymethacrylates, polyvinyl acetate, petroleum resins, rosins, and modified rosins).

Encapsulation methods for preparing toner particles having a capsular structure are not particularly limited. However, an encapsulation method employing interfacial polymerization is superior from the standpoints of completeness of encapsulation and mechanical strength of shells. As the encapsulation method employing interfacial polymerization, known methods may be used. For example, in order to encapsulate a binder resin as an ingredient for a core material, there may be used a method in which the ingredient that has been polymerized beforehand is introduced into a reactor along with other core material ingredient(s) (e.g., colorant), a low-boiling solvent, and shell-forming ingredient(s), and shells are formed by interfacial polymerization with expelling of the low-boiling solvent from the capsule; or a method in which the binder resin for the core material is introduced in its monomeric state into a reactor along with other core material ingredient(s), a low-boiling solvent, and shell-forming ingredients, shells are formed by interfacial polymerization, and then the encapsulated monomer of the binder resin is polymerized to form the core material. For the encapsulation methods, reference may be made to JP-A-57-179860, JP-A-58-66948, JP-A-59-148066, and JP-A-59-162562.

Copolymer which is to be adherent to the surfaces of the above-described toner particles is explained below.

The copolymer contains as monomer units at least one vinyl group-containing carboxylic acids represented by formulae (I), (II), and (III) described hereinabove and a fluorine-containing vinyl monomer. Of the monomers represented by formula (II), those having n of 1 to 4 are preferred.

Examples of the vinyl group-containing carboxylic acids represented by formulae (I), (II), and (III) include acrylic acid, methacrylic acid, vinylacetic acid, vinylpropionic acid, and vinylbenzoic acid.

As the fluorine-containing vinyl monomer, a compound represented by the following general formula (IV) is preferably used.

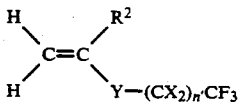

(IV)

wherein X represents hydrogen atom or fluorine atom, Y represents

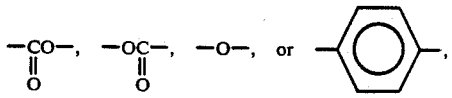

$R_2$ represents hydrogen atom or an alkyl group having 1 to 3 carbon atoms, and n' is 0 or an integer of 1 to 7, preferably 2 to 4.

Specific examples of the fluorine atom-containing vinyl monomer represented by formula (IV) above include trifluoroethyl acrylate, vinyl trifluoroacetate, trifluoromethyl vinyl ether, trifluorethyl vinyl ether, pentafluoropropyl acrylate, pentafluoropropyl methacrylate, trifluoropropyl acrylate, trifluoropropyl methacrylate, trifluorobutyl acrylate, trifluorobutyl methacrylate, trifluoropentyl acrylate, trifluoropentyl methacrylate, trifluorohexyl acrylate, trifluorohexyl methacrylate, pentafluorooctyl methacrylate, and the like. Particularly preferred are trifluoroethyl acrylate, vinyl trifluoroacetate, and trifluorethyl vinyl ether.

In this invention, the copolymer described above may further contain monomer units of a third monomer which is a vinyl monomer copolymerizable with the above-described monomers. Examples of the third monomer include acrylic or methacrylic (hereafter collectively referred to as "(meth)acrylic") acid esters such as methyl (meth)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate, and phenyl (meth)acrylate; vinyl group-containing cyano compounds such as acrylonitrile, methacrylonitrile, and cyanostyrene; vinyl esters of fatty acids, such as vinyl formate, vinyl acetate, vinyl propionate, vinyl butyrate, vinyl trimethylacetate, vinyl caproate, vinyl caprylate, and vinyl stearate; vinyl ethers such as ethyl vinyl ether, propyl vinyl ether, butyl vinyl ether, hexyl vinyl ether, 2-ethylhexyl vinyl ether, and phenyl vinyl ether; vinyl ketones such as methyl vinyl ketone and phenyl vinyl ketone; vinyl aromatic compounds such as styrene, chlorostyrene, hydroxystyrene, and α-methylstyrene; and the like.

In this invention, the copolymerization ratio of the vinyl group-containing carboxylic acids of formulae (I), (II), and (III) is in the range of preferably from 0.1 to 90 mol, more preferably from 1 to 40 mol, per 10 mol of the flourine-containing vinyl monomer. If the copolymerization ratio of the vinyl group-containing carboxylic acid is outside the above range, electrification stability tends to be lowered.

The amount of the fluorine-containing vinyl monomer copolymerized is preferably 5 mol% or more, more preferably 10 mol% or more, based on the amount of all the monomer components constituting the copolymer. If the content of fluorine-containing vinyl monomer units in the copolymer is below 5 mol%, the independency of electrification on the environment of the toner tends to be deteriorated.

In the case where the copolymer contains monomer units derived from the third monomer described above, the amount of the third monomer copolymerized is preferably 100 mol or less, more preferably 50 mol or less, per 10 mol of the fluorine-containing vinyl monomer.

The polymerization degree of the above-described copolymer to be adherent to the surfaces of the toner particles is preferably in the amount of from 20 to 2,000 and more preferably from 100 to 500. The preferred amount of the copolymer adherent to the toner surfaces is from 0.1 to 20 parts by weight per 100 parts by weight of the toner particles.

For making the above-described copolymer adhere to toner particle surfaces according to the present invention, various methods may be employed. However, methods in which the monomers are graft-polymerized onto the toner particles surfaces are preferred.

The graft polymerization is preferably accomplished by, for example, (1) a method in which either at least one monomer selected from the vinyl group-containing carboxylic acids represented by formulae (I), (II), and (III) and the fluorine-containing vinyl monomer described above or these monomers and other vinyl monomer(s) copolymerizable therewith are redox-polymerized on the surfaces of toner particles in the presence of a Ce(IV) catalyst; or (2) a method in which a monomer having two or more radical chain transfer groups is graft-polymerized in the presence of a Ce(IV) catalyst, and then either at least one monomer selected from the vinyl group-containing carboxylic acids represented by formulae (I), (II), and (III) and the fluorine-containing vinyl monomer described above or these monomers and other vinyl monomer(s) copolymerizable therewith are radical-polymerized using a radical polymerization initiator such as a peroxide, an azo compound, etc., or a redox polymerization initiator consisting of a combination of a peroxide and a reducing agent.

The above graft polymerization methods employing Ce(IV) are described in detail in "Graft Polymerization and its Applications" written by Fumio Ide, published by Kobunshi Kankokai, Japan.

Examples of the radical polymerization initiator for use in method (2) above include hydrogen peroxide, potassium persulfate, ammonium peroxodisulfate, alkyl hydroperoxides, dialkyl peroxides, diacyl peroxides, peroxyesters, azo compounds, and the like. Examples of the redox polymerization initiator include combinations of peroxides, such as persulfates, hydrogen peroxide, hydroperoxides, etc., with various reducing agents. Specific examples thereof include a combination of hydrogen peroxide and a ferrous salt, a combination of benzoyl peroxide and dimethylaniline, a combination of potassium persulfate and $NaHSO_3$, and the like.

Examples of the monomer having two or more radical chain transfer groups include polyacrylates and polymethacrylates of polyhydric alcohols, such as ethylene glycol diacrylate, ethylene glycol dimethacrylate, diethylene glycol dimethacrylate, trimethylolpropane triacrylate, and pentaerythritol dimethacrylate; reaction products of acrylic acid with amines, which have two or more acrylic groups; polyvinyl ethers of polyhydric alcohols, such as ethylene glycol divinyl ether; polyvinyl esters of polycarboxylic acids, such as divinyl succinate and divinyl phthalate; aromatic compounds having two or more vinyl groups, such as divinylbenzene and p-allylstyrene; and the like. The amount of the polymer chains obtained from such a monomer having two or more radical chain transfer groups is preferably from 0.05 to 10% by weight based on the amount of the whole toner.

Another useful method for making the above-described copolymer adhere to the surfaces of toner particles is to disperse the tonre particles into a solution or dispersion of the copolymer and then dry the resulting dispersio by a spray drying technique.

Because of the above-described copolymer adherent to the surfaces of the toner particles, the resulting toner shows good electrification stability to the environment and has the property of being negatively charged with a sharp charge distribution. Further, the toner can stably produce copied images having excellent image quality over a prolonged period of time since the electrification properties of the toner are never impaired by mechanical force. Furthermore, the toner for electrophotography of this invention is also advantageous in that it can be prepared with considerable latitude in selection of starting materials without necessity of a special reactor.

The present invention will be explained in more detail with reference to the following Examples and Comparative Examples, but the Examples should not be construed as limiting the scope of the invention. In the Examples and Comparative Examples, all parts and percents are by weight, unless otherwise indicated.

EXAMPLE 1

(1) Preparation of Capsular Particles

In a liquid mixture of 60 g of dibutylnaphthalene and 60 g of ethyl acetate were dissolved 30 g of poly(isobutyl methacrylate) $Mw = 16 \times 10^4$) and 40 g of a styrene-n-butyl methacrylate copolymer ($Mw = 6 \times 10^4$). To this solution was added 120 g of a magnetic powder (EPT-1000, manufactured by Toda Kogyo Corporation, Japan). The resulting mixture was dispersed with a ball mill for 16 hours. Subsequently, 30 g of an isocyanate (Sumidule L, manufactured by Sumitomo Bayer Urethane Co., Ltd., Japan) and 24 g of ethyl acetate were added to 200 g of the above-obtained dispersion, and they were sufficiently mixed. (The resulting liquid is designated "Liquid A".)

On the other hand, 10 g of hydroxypropyl methyl cellulose (Metolose 65H50, manufactured by Shin-Etsu Chemical Co., Ltd., Japan) was dissolved in 200 g of ion-exchanged water, and this solution was cooled to 5° C. (The resulting liquid is designated "Liquid B".) While Liquid B was being agitated with an emulsifier (Autohomomixer, manufactured by Tokushuki Kako Co., Ltd., Japan), Liquid A was slowly poured thereinto, thereby emulsifying Liquid A. Thus, an O/W emulsion was obtained in which the dispersed oil droplets had an average particle diameter of about 12 μm. The emulsifier was then replaced with a stirrer (Three One Motor, manufactured by Shinto Kagaku Co., Ltd., Japan) having a propeller-type stirring element, and the dispersion was stirred at 400 rpm. Ten minutes later, 100 g of a 5% aqueous solution of diethylenetriamine was added dropwise to the dispersion. Thereafter, the resulting mixture was heated to 60° C. and an encapsulation reaction was conducted for 3 hours. After completion of the reaction, the reaction mixture was poured into 2 liters of ion-exchanged water, and this mixture was stirred sufficiently and then allowed to stand. After capsular particles precipitated, the supernatant was removed. This procedure was repeated 7 times to wash the particles. Thus, capsular particles containing an oil-based binder were obtained. Ion-exchanged water was then added to the capsular particles to give a suspension having a solid content of 40%.

(2) Preparation of Toner

To 125 g of the capsular particle suspension prepared in (1) above (corresponding to 50 g of the capsular particles) was added 125 g of ion-exchanged water. This mixture was stirred at 200 rpm with a stirrer (Three One Motor). Thereto were added 5 g of 1 N nitric acid and 4 g of a 10% aqueous solution of cerium sulfate, followed by 0.5 g of ethylene glycol dimethacrylate, and reaction was allowed to proceed at 15° C. for 3 hours. After completion of the reaction, the reaction mixture was poured into 1 liter of ion-exchanged water, and this mixture was stirred sufficiently and then allowed to stand. After the capsular particles precipitated, the supernatant was removed. This procedure was repeated twice to wash the particles. Thus, capsular particles in which ethylene glycol dimethacrylate had been graft-polymerized onto the surfaces of the capsule shells were obtained. The resulting capsular particles were resuspended in ion-exchanged water, and this suspension was stirred at 200 rpm with a stirrer (Three One Motor). Thereto was then added a liquid mixture of 0.4 g of potassium persulfate, 1 g of trifluoroethyl methacrylate, and 1 g of methacrylic acid, followed by 0.16 g of sodium hydrogen sulfite, and reaction was allowed to proceed at 25° C. for 3 hours. After completion of the reaction, the reaction mixture was poured into 2 liters of ion-exchanged water, and this mixture was stirred sufficiently and then allowed to stand. After the capsular particles precipitated, the supernatant was removed. This procedure was repeated 4 times to wash the particles. Thus, a capsule toner was obtained which had a trifluoroethyl methacrylate- methacrylic acid copolymer graft-polymerized onto the surfaces of the capsule shells. The thus-obtained capsule suspension was poured into a stainless-steel vat and dried with a dryer (manufactured by Yamato Kagaku Co., Ltd., Japan) at 60° C for 10 hours.

(3) Evaluation Test

In an atmosphere at 20° C. and 50%RH, 3 g of the above-obtained capsule toner was mixed with 100 g of a carrier consisting of iron powder particles coated with a phenolic resin, and the amount of electricity with which the capsule toner was charged was measured by the blow-off method as described in *Xerography and Related Processes*, p.289 and 309 (Focal Press, London and Newyork, 1965). As a result, the charged electricity amount was found to be $-16\ \mu C/g$. Likewise, the toner was mixed with the same carrier in an atmosphere at 28° C. and 80%RH, and the amount of electricity of the capsule toner charged was measured by the blow-off method and was found to be $-14\ \mu C/g$. Thereafter, 1 part of hydrophobic silica (R972, manufactured by Nippon Aerosil Co., Ltd., Japan) was added to 100 parts of the above toner (without the carrier), and they were mixed sufficiently and then subjected to image quality evaluation in a high-temperature and high-humidity atmosphere at 35° C. and 85%RH. The copying machine used was a modified machine of Type 2700 manufactured by Fuji Xerox Co., Ltd., Japan so as to suit to capsule toners, and copy samples were produced by reversal development. As a result, clear copies free from fogging were stably obtained even after 20,000 copies were produced.

Immediately after the 20,000th copy sample was taken, the charge distribution in the toner present in the sleeve in the developing system was measured. As a result, the toner showed a sharp charge distribution, with the amount of reversely charged toner particles being 5% or less based on the total amount of toner.

COMPARATIVE EXAMPLE 1

The same procedures for preparing a toner as in Example 1 were repeated except that the liquid mixture of 1 g of trifluoroethyl methacrylate and 1 g of methacrylic acid was replaced with 2 g of methacrylic acid. Thus, a capsule toner was obtained in which methacrylic acid had been graft-polymerized onto the surfaces of the capsule shells. In an atmosphere at 20° C. and 50%RH, 3 g of the above-obtained capsule toner was mixed with 100 g of a carrier consisting of iron powder particles coated with a phenolic resin, and the amount of electricity with which the capsule toner was charged was measured by the blow-off method. As a result, the charged electricity amount was found to be $-10\ \mu C/g$. Likewise, the toner was mixed with the same carrier in an atmosphere at 28° C. and 80%RH, and the amount of electricity of the capsule toner charged was measured by the blow-off method and was found to be $-4\ \mu C/g$. Thereafter, 1 part of hydrophobic silica (R972, manufactured by Nippon Aerosil Co., Ltd.) was added to 100 parts of the above toner, and they were mixed sufficiently and then subjected to image quality evaluation in the same manner as in Example 1 in a high-temperature and high-humidity atmosphere at 35° C. and 85%RH. As aresult, fogging occurred from the 10th copy sample, and the 100th sample had impaired image quality with a lowered image density and very poor clearness.

Immediately after the 100th copy sample was taken, the charge distribution in the toner present in the sleeve in the developing system was measured. As a result, the toner showed a broad charge distribution, with the amount of reversely charged toner particles being 50% or more based on the total amount of toner.

EXAMPLE 2

(1) Preparation of Capsular Particles

In 150 g of monomeric lauryl methacrylate was dissolved 30 g of polyisobutyl methacrylate (Mw $=16\times10^4$). To this solution was added 20 g of a red pigment (Hosta Perm Scarlet, manufactured by Bayer Co.). The resulting mixture was dispersed with a ball mill for 16 hours. Subsequently, 10 g of an isocyanate (Sumidule L, manufactured by Sumitomo Bayer Urethane Co., Ltd.), 5 g of toluylene diisocyanate (Coronate T, manufactured by Nippon Polyurethane Industry Co., Ltd., Japan), and 3 g of azobisisovaleronitrile were added to 200 g of the above-obtained dispersion, and they were sufficiently mixed. (The resulting liquid is designated "Liquid C".)

On the other hand, 10 g of hydroxypropyl methyl cellulose (Metholose 65H50, manufactured by Shin-Etsu Chemical Co., Ltd.) was dissolved in 250 g of ion-exchanged water, and this solution was cooled to 5° C. (The resulting liquid is designated "Liquid D".) While Liquid D was being agitated with an emulsifier (Autohomomixer), Liquid C was slowly poured thereinto, thereby emulsifying Liquid C. Thus, an O/W emulsion was obtained in which the dispersed oil droplets had an average particle diameter of about 12 μm. The emulsifier was then replaced with a stirrer (Three One Motor) and the dispersion was stirred at 400 rpm. Ten minutes later, 100 g of a 2.5% aqueous solution of diethylenetriamine was added dropwise to the dispersion. Thereafter, the resulting mixture was kept being stirred at room temperature thereby to conduct an encapsulation reaction for 2 hours, and was then heated at 65° C. for 14 hours thereby to polymerize the encapsulated monomer to form a core material. After completion of the reaction, the reaction mixture was poured into 2 liters of ion-exchanged water, and this mixture was stirred sufficiently and then centrifuged. After capsular particles were separated, the supernatant was removed. This procedure was repeated 5 times, followed by washing with methanol. Thus, red capsular particles containing a soft solid substance were obtained. Ion-exchanged water was then added to the capsular particles to give a suspension having a solid content of 40%.

(2) Preparation of Toner

To 125 g of the capsular particle suspension prepared in (1) above (corresponding to 50 g of the capsular particles) was added 125 g of ion-exchanged water. This mixture was stirred at 200 rpm with a stirrer (Three One Motor). Thereto were added 5 g of 1 N nitric acid and 4 g of a 10% aqueous solution of cerium sulfate, followed by 0.5 g of ethylene glycol dimethacrylate, and reaction was allowed to proceed at 15° C. for 3 hours. After completion of the reaction, the reaction mixture was poured into 1 liter of ion-exchanged water, and this mixture was stirred sufficiently and then centrifuged. After the capsular particles were separated, the supernatant was removed. This procedure was repeated twice to wash the particles. Thus, capsular particles in which ethylene glycol dimethacrylate had been graft-polymerized onto the surfaces of the capsule shells were obtained. The resulting capsular particles were resuspended in ion-exchanged water, and this suspension was stirred at 200 rpm with a stirrer (Three One Motor). Thereto was then added a liquid mixture of 0.4 g of potassium persulfate, 1 g of trifluoroethyl methacrylate, and 1 g of vinylacetic acid, followed by 0.16 g of sodium hydrogen sulfite, and reaction was allowed to proceed at 25° C. for 3 hours. After completion of the reaction, the reaction mixture was poured into 2 liters of ion-exchanged water, and this mixture was stirred sufficiently and then centrifuged. After the capsular particles were separated, the supernatant was removed. This procedure was repeated 4 times to wash the particles. Thus, a capsule toner was obtained which had a trifluoroethyl methacrylate- vinylacetic acid copolymer graft-polymerized onto the surfaces of the capsule shells. The thus-obtained capsule suspension was poured into a stainless-steel vat and dried with a dryer (manufactured by Yamato Kagaku Co., Ltd.) at 60° C. for 10 hours.

(3) Evaluation Test

In an atmosphere at 20° C. and 50%RH, 3 g of the above-obtained capsule toner was mixed with 100 g of a carrier consisting of iron powder particles coated with a phenolic resin, and the amount of electricity of the capsule toner charged was measured by the blow-off method. As a result, the charged electricity amount was found to be −14 μC/g. Likewise, the toner was mixed with the same carrier in an atmosphere at 28° C. and 80%RH, and the amount of electricity of the capsule toner charged was measured by the blow-off method and was found to be −12 μC/g. Thereafter, 1 part of hydrophobic silica (R972, manufactured by Nippon Aerosil Co., Ltd.) was added to 100 parts of the above toner, and they were mixed sufficiently and then subjected to image quality evaluation in a high-temperature and high-humidity atmosphere at 35° C. and 85%RH. The copying machine used was a modified machine of Type 2700 manufactured by Fuji Xerox Co., Ltd. so as to suit to capsule toners, and copy samples were produced by reversal development. As a result, clear copies free from fogging were stably obtained even after 20,000 copies were produced.

Immediately after the 20,000th copy sample was taken, the charge distribution in the toner present in the sleeve in the developing system was measured. As a result, the toner showed a sharp charge distribution, with the amount of reversely charged toner particles being 5% or less based on the total amount of toner.

COMPARATIVE EXAMPLE 2

The same procedures for preparing a toner as in Example 2 were repeated except that the liquid mixture of 1.0 g of trifluoroethyl methacrylate and 1 g of vinylacetic acid was replaced with 2.5 g of vinylacetic acid. Thus, a capsule toner was obtained in which vinylacetic acid had been graft-polymerized onto the surfaces of the capsule shells. In an atmosphere at 20° C. and 50%RH, 3 g of the above-obtained capsule toner was mixed with 100 g of a carrier consisting of iron powder particles coated with a phenolic resin, and the amount of electricity of the capsule toner charged was measured by the blow-off method. As a result, the charged electricity amount was found to be −12 μC/g. Likewise, the toner was mixed with the same carrier in an atmosphere at 28° C. and 80%RH, and the amount of electricity of the capsule toner charged was measured by the blow-off method and was found to be −4 μC/g. Thereafter, 1 part of hydrophobic silica (R972, manufactured by Nippon Aerosil Co., Ltd.) was added to 100 parts of the above toner, and they were mixed sufficiently and then subjected to image quality evaluation in the same manner as in Example 2 in a high-temperature and high-humidity atmosphere at 35° C. and 85%RH. As a result, fogging occurred from the 10th copy sample, and the 100th sample had impaired image quality with a lowered image density and very poor clearness.

Immediately after the 100th copy sample was taken, the charge distribution in the toner present in the sleeve in the developing system was measured. As a result, the toner showed a broad charge distribution, with the amount of reversely charged toner particles being 50% or more based on the total amount of toner.

EXAMPLE 3

(1) Preparation of Capsular Particles

In a liquid mixture of 80 g of monomeric styrene and 80 g of monomeric n-butyl methacrylate was dissolved 30 g of a styrene-n-butyl methacrylate copolymer (Mw =20,000). To this solution was added 21 g of a yellow pigment (Chromophthal Yellow A2R, manufactured by CIBA-GEIGY Co.). The resulting mixture was treated with a ball mill for 16 hours to disperse the pigment. Subsequently, 8 g of an isocyanate (Sumidule L, manufactured by Sumitomo Bayer Urethane Co., Ltd.), 4 g of tolylene diisocyanate (Coronate T, manufactured by Nippon Polyurethane Industry Co., Ltd.), 4 g of an epoxy resin (Epikote 812, manufactured by Yuka Shell Epoxy Co., Ltd., Japan), and 3 g of azobisisobutylonitrile were added to 200 g of the above-obtained dispersion, and they were sufficiently mixed. (The resulting liquid is designated "Liquid E".)

On the other hand, 10 g of hydroxypropyl methyl cellulose (Metholose 65H50, manufactured by Shin-Etsu Chemical Co., Ltd.) was dissolved in 250 g of ion-exchanged water, and this solution was cooled to 5° C. (The resulting liquid is designated "Liquid F".) While Liquid F was being agitated with an emulsifier (Autohomomixer), Liquid E was slowly poured thereinto, thereby emulsifying Liquid E. Thus, an O/W emulsion was obtained in which the dispersed oil droplets had an average particle diameter of about 12 μm. The emulsifier was then replaced with a stirrer (Three One Motor) and the dispersion was stirred at 400 rpm. Ten minutes later, 100 g of a 2.5% aqueous solution of diethylenetriamine was added dropwise to the dispersion. Thereafter, the resulting mixture was stirred at room temperature thereby to conduct an encapsulation reaction for 2 hours, and was then heated at 65° C. for 14 hours thereby to polymerize the encapsulated monomers to form a core material. After completion of the reaction, the reaction mixture was poured into 2 liters of ion-exchanged water, and this mixture was stirred sufficiently and then centrifuged. After capsular particles were separated, the supernatant was removed. This procedure was repeated 5 times, followed by washing with methanol. Thus, yellow capsular particles were obtained. Ion-exchanged water was then added to the capsular particles to give a suspension having a solid content of 40%.

(2) Preparation of Toner

To 125 g of the capsular particle suspension prepared in (1) above (corresponding to 50 g of the capsular particles) was added 125 g of ion-exchanged water. This mixture was stirred at 200 rpm with a stirrer (Three One Motor). Thereto were added 5 g of 1 N nitric acid and 4 g of a 10% aqueous solution of cerium sulfate, followed by 0.5 g of ethylene glycol dimethacrylate, and reaction was allowed to proceed at 15° C. for 3 hours. After completion of the reaction, the reaction mixture was poured into 1 liter of ion-exchanged water, and this mixture was stirred sufficiently and then centrifuged. After the capsular particles were separated, the supernatant was removed. This procedure was repeated twice to wash the particles. Thus, capsular particles in which ethylene glycol dimethacrylate had been graft-polymerized onto the surfaces of the capsule shells were obtained. The resulting capsular particles were resuspended in ion-exchanged water, and this suspension was stirred at 200 rpm with a stirrer (Three One Motor). Thereto was then added a liquid mixture of 0.4 g of potassium persulfate, 1.5 g of trifluoroethyl methacrylate, and 1 g of vinylbenzoic acid, followed by 0.16 g of sodium hydrogen sulfite, and reaction was allowed to proceed at 25° C. for 3 hours. After completion of the reaction, the reaction mixture was poured into 2 liters of ion-exchanged water, and this mixture was stirred sufficiently and then centrifuged. After the capsular particles were separated, the supernatant was removed. This procedure was repeated 4 times to wash the particles. Thus, a capsule toner was obtained which had a trifluoroethyl methacrylate- vinylbenzoic acid copolymer graft-polymerized onto the surfaces of the capsule shells. The thus-obtained capsule suspension was poured into a stainless-steel vat and dried with a dryer (manufactured by Yamato Kagaku Co., Ltd.) at 60° C. for 10 hours.

(3) Evaluation Test

In an atmosphere at 20° C. and 50%RH, 3 g of the above-obtained capsule toner was mixed with 100 g of a carrier consisting of iron powder particles coated with a phenolic resin, and the amount of electricity of the capsule toner charged was measured by the blow-off method. As a result, the charged electricity amount was found to be $-16\ \mu C/g$. Likewise, the toner was mixed with the same carrier in an atmosphere at 28° C. and 80%RH, and the amount of electricity of the capsule toner charged was measured by the blow-off method and was found to be $-12\ \mu C/g$. Thereafter, 1 part of hydrophobic silica (R972, manufactured by Nippon Aerosil Co., Ltd.) was added to 100 parts of the above toner, and they were mixed sufficiently and then subjected to image quality evaluation in a high-temperature and high-humidity atmosphere at 35° C. and 85%RH. The copying machine used was a modified machine of Type 2700 manufactured by Fuji Xerox Co., Ltd. so as to suit to capsule toners, and copy samples were produced by reversal development. As a result, clear copies free from fogging were stably obtained even after 20,000 copies were produced.

Immediately after the 20,000th copy sample was taken, the charge distribution in the toner present in the sleeve in the developing system was measured. As a result, the toner showed a sharp charge distribution, with the amount of reversely charged toner particles being 5% or less based on the total amount of toner.

EXAMPLE 4

(1) Preparation of Capsular Particles

In a liquid mixture of 40 g of monomeric styrene, 20 g of monomeric isobutyl methacrylate, and 20 g of 2-hydroxyethyl methacrylate was dissolved 30 g of a styrene-n-butyl methacrylate copolymer (Mw =20,000). To this solution was added 4 g of carbon black (MA-600, manufactured by Mitsubishi Chemical Industries Ltd., Japan). The resulting mixture was treated with a ball mill for 24 hours to disperse the carbon black. Subsequently, 3 g of azobisisobutylonitrile was added to 100 g of the above-obtained dispersion, and they were mixed. (The resulting liquid is designated "Liquid G".)

On the other hand, 5 g of hydroxypropyl methyl cellulose (Metholose 65H50, manufactured by Shin-Etsu Chemical Co., Ltd.) and 1 g of polyvinyl alcohol (PVA110, manufactured by Kuraray Co., Ltd., Japan) were dissolved in 250 g of ion-exchanged water, and this solution was cooled to 5° C. (The resulting liquid is designated "Liquid H".) While Liquid H was being agitated with an emulsifier (Autohomomixer), Liquid G was slowly poured thereinto, thereby emulsifying Liquid G. Thus, an O/W emulsion was obtained in which the dispersed oil droplets had an average particle diameter of about 12 μm. The emulsifier was then replaced with a stirrer (Three One Motor), and reactions were allowed to proceed at 65° C. for 16 hours with stirring at 400 rpm thereby to polymerize the monomers. After completion of the reactions, the reaction mixture was poured into 2 liters of ion-exchanged water, and this mixture was stirred sufficiently and then centrifuged. After capsular particles were separated, the supernatant was removed. This procedure was repeated 5 times, followed by washing with methanol. Thus, black capsular particles were obtained. Ion-exchanged water was then added to the capsular particles to give a suspension having a solid content of 40%.

(2) Preparation of Toner

To 125 g of the capsular particle suspension prepared in (1) above (corresponding to 50 g of the capsular particles) was added 125 g of ion-exchanged water. This mixture was stirred at 200 rpm with a stirrer (Three One Motor). Thereto were added 5 g of 1 N nitric acid and 4 g of a 10% aqueous solution of cerium sulfate, followed by 0.5 g of ethylene glycol dimethacrylate, and reaction was allowed to proceed at 15° C. for 3 hours. After completion of the reaction, the reaction mixture was poured into 1 liter of ion-exchanged water, and this mixture was stirred sufficiently and then centrifuged. After the capsular particles were separated, the supernatant was removed. This procedure was repeated twice to wash the particles. Thus, capsular particles in which ethylene glycol dimethacrylate had been graft-polymerized onto the surfaces of the capsule shells were obtained. The resulting capsular particles were resuspended in ion-exchanged water, and this suspension was stirred at 200 rpm with a stirrer (Three One Motor). Thereto was then added a liquid mixture of 0.4 g of potassium persulfate, 1.5 g of trifluoroethyl methacrylate, and 1 g of vinylbenzoic acid, followed by 0.16 g of sodium hydrogen sulfite, and reaction was allowed to proceed at 25° C. for 3 hours. After completion of the reaction, the reaction mixture was poured into 2 liters of ion-exchanged water, and this mixture was stirred sufficiently and then centrifuged. After the capsular particles were separated, the supernatant was removed. This procedure was repeated 4 times to wash the particles. Thus, a black capsule toner was obtained which had a trifluoroethyl methacrylate- vinylbenzoic acid copolymer graft-polymerized onto the surfaces of the capsule shells. The thus-obtained capsule suspension was poured into a stainless-steel vat and dried with a dryer (manufactured by Yamato Kagaku Co., Ltd.) at 40° C. for 20 hours.

(3) Evaluation Test

In an atmosphere at 20° C. and 50%RH, 3 g of the surface-treated capsule toner obtained above was mixed with 100 g of a carrier consisting of iron powder particles coated with a phenolic resin, and the amount of electricity of the capsule toner charged was measured by the blow-off method. As a result, the charged electricity amount was found to be −13 μC/g. Likewise, the toner was mixed with the same carrier in an atmosphere at 28° C. and 80%RH, and the amount of electricity of the capsule toner charged was measured by the blow-off method and was found to be −11 μC/g. Thereafter, 1 part of hydrophobic silica (R972, manufactured by Nippon Aerosil Co., Ltd.) was added to 100 parts of the above toner, and they were mixed sufficiently and then subjected to image quality evaluation in a high-temperature and high-humidity atmosphere at 35° C. and 85%RH. The copying machine used was a modified machine of Type 2700 manufactured by Fuji Xerox Co., Ltd. so as to suit to capsule toners, and copy samples were produced by reversal development. As a result, clear copies free from fogging were stably obtained even after 20,000 copies were produced.

Immediately after the 20,000th copy sample was taken, the charge distribution in the toner present in the sleeve in the developing system was measured. As a result, the toner showed a sharp charge distribution, with the amount of reversely charged toner particles being 5% or less based on the total amount of all toner particles.

COMPARATIVE EXAMPLE 3

To 125 g of the capsular particle suspension prepared in (1) in Example 4 (corresponding to 50 g of the capsular particles) was added 3 g of a fluorine-contained resin in the form of a fine powder (average particle diameter 0.2 to 0.4 μm), and they were mixed by stirring. The resulting mixture was poured into a stainless-steel vat and dried with a dryer (manufactured by Yamato Kagaku Co., Ltd.) at 40° C. for 20 hours. Thus, a black capsule toner was obtained in which the fluorine-contained resin in a fine powder form was adherent to the surfaces of the toner particles. In an atmosphere at 20° C. and 50%RH, 3 g of the above-obtained capsule toner was mixed with 100 g of a carrier consisting of iron powder particles coated with a phenolic resin, and the amount of electricity of the capsule toner charged was measured by the blow-off method. As a result, the charged electricity amount was found to be −12 μC/g. Likewise, the toner was mixed with the same carrier in an atmosphere at 28° C. and 80%RH, and the amount of electricity of the capsule toner charged was measured by the blow-off method and was found to be −8 μC/g. Thereafter, 1 part of hydrophobic silica (R972, manufactured by Nippon Aerosil Co., Ltd.) was added to 100 parts of the above capsule toner, and they were mixed sufficiently and then subjected to image quality evaluation in the same manner as in Example 2 in a high-temperature and high-humidity atmosphere at 35° C. and 85%RH. As a result, fogging occurred from the 2,000th copy sample, and the 2,500th sample ha impaired image quality with a lowered image density and very poor clearness.

Immediately after the 2,500th copy sample was taken, the charge distribution in the toner present in the sleeve in the developing system was measured. As a result, the toner showed a broad charge distribution, with the amount of reversely charged toner particles being 50% or more based on the total amount of all toner particles.

While the invention has been described in detail and with reference to specific embodiments thereof, it will be apparent to one skilled in the art that various changes and modifications can be made therein without departing from the spirit and scope thereof.

What is claimed is:

1. A toner for electrophotography which comprises toner particles having a radical-formable substance at least on the surfaces thereof and a copolymer chemically bonded to said surfaces, said copolymer containing as monomer units at least one vinyl group-containing carboxylic acid represented by formulae (I), (II), and (III) and a fluorine-containing vinyl monomer that is not gaseous at room temperature:

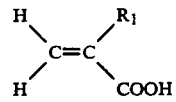

(I)

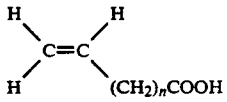

(II)

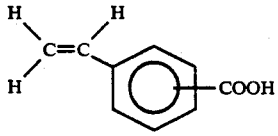

(III)

wherein $R_1$ represents a hydrogen atom or methyl group and n is an integer of 1 to 8.

2. A toner for electrophotography as in claim 1, wherein said toner particles have a capsular structure.

3. A toner for electrophotography as in claim 2, wherein the capsule shells consist of at least one of a polyurea resin and a polyurethane resin, or at least one of an epoxy-urea resin and an epoxy-urethane resin.

4. A process for producing a toner for electrophotography, which comprises graft-polymerizing a monomer having two or more radical chain transfer groups onto the surfaces of toner particles having a radical-formable substance at least on the surfaces thereof, and then graft-polymerizing either at least one vinyl group-containing carboxylic acid represented by formulae (I), (II), and (III) and a fluorine-containing vinyl monomer that is not gaseous at room temperature, or said at least one vinyl group-containing carboxylic acid, a fluorine-containing vinyl monomer that is not gaseous at room temperature and other copolymerizable vinyl monomer(s):

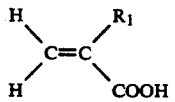

(I)

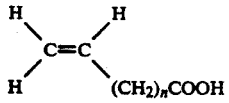

(II)

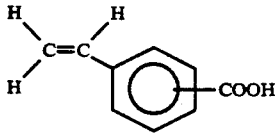

(III)

wherein $R_1$ represents a hydrogen atom or methyl group and n is an integer of 1 to 8.

* * * * *